US006655989B1

(12) United States Patent
Gale et al.

(10) Patent No.: US 6,655,989 B1
(45) Date of Patent: Dec. 2, 2003

(54) ENVIRONMENTALLY SEALED ELECTRICAL CONNECTOR SYSTEM

(75) Inventors: Allan Roy Gale, Livonia, MI (US); Jeffrey William Nieman, New Boston, MI (US); Philip Thomas Koneda, Novi, MI (US); Stephen John Agdorny, Ypsilanti, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/064,403

(22) Filed: Jul. 10, 2002

(51) Int. Cl.[7] ..... H01R 13/73
(52) U.S. Cl. ..... 439/559; 439/906
(58) Field of Search ..... 439/556, 559, 439/271, 272, 273, 906, 687, 696, 465, 686, 694, 595

(56) References Cited

U.S. PATENT DOCUMENTS

| | | | | | |
|---|---|---|---|---|---|
| 3,750,088 | A | * | 7/1973 | Berian | 439/556 |
| 3,798,586 | A | | 3/1974 | Huska | |
| 3,949,343 | A | | 4/1976 | Yonkers | |
| 3,999,830 | A | * | 12/1976 | Herrmann, Jr. et al. | 439/556 |
| 4,447,103 | A | * | 5/1984 | Werth et al. | 439/556 |
| 4,684,190 | A | * | 8/1987 | Clark et al. | 439/559 |
| 5,248,265 | A | * | 9/1993 | Goto et al. | 439/559 |
| 5,823,811 | A | | 10/1998 | Blanchfield et al. | |
| 6,099,325 | A | | 8/2000 | Parkhill | |
| 6,155,871 | A | | 12/2000 | Machado | |
| 6,402,565 | B1 | * | 6/2002 | Polley et al. | 439/559 |

* cited by examiner

*Primary Examiner*—P. Austin Bradley
*Assistant Examiner*—Briggitte R. Hammond
(74) *Attorney, Agent, or Firm*—Dykema Gossett PLLC; Carlos L. Hanze

(57) ABSTRACT

An electrical connection system adapted to be environmentally sealed by mounting a conductor block having at least one electrical conductor within a port extending through an electrical component. A first cover portion is telescopically engaged with the conductor block and has at least one wire channel formed therein. A seal is disposed against and extends about the periphery of the front portion of the non-conductive block. A second cover portion is configured to sealingly mate with the first cover portion and configured to engage the non-conductive block whereby electrical leads are retained.

8 Claims, 7 Drawing Sheets

ENVIRONMENTALLY SEALED ELECTRICAL CONNECTOR SYSTEM

BACKGROUND OF INVENTION

The present invention relates generally to an electrical connection system, and more particularly to an environmentally sealed electrical connection system capable of carrying high current in a package efficient manner.

Electrical connection systems are becoming increasingly important in applications that require both environmental isolation and high current capacity, as in electrodrive vehicles or with vehicles having an integrated alternator system. Of course, sealing from the environment and carrying high current are especially difficult to design for in areas such as an engine compartment or underhood applications where protection from the environment is particularly challenging.

Generally, a wire harness with many wires and terminals for electrical connections is provided in a vehicle electrical system. At times the connection system must pass through a fixed area such as a dash panel, engine, or transmission. One current method of sealing such system is to use a connector, which includes a seal on both the male and female ends of the connection. Alternatively, small internal seals are placed around the individual wires prior to being pressed into the connector. However, these types of connections pose many problems. Often the connection, though sealed, is not capable of carrying high current due to the wire size required for individual connector. Additionally, these systems are sealed at each termination point, thus increasing the possibility of failure or leakage. Examples of such prior art connectors can be found in U.S. Pat. No. 5,823,811.

Therefore, a need exists for an electrical connection system which is capable of mating two electrical components where one of the components is susceptible to fluid contamination, such as oil and/or water. The term "electrical component" means without limitation, motors, switchgear, power transmissions, starters or other electrical, electronic, or electro-mechanical devices known to those skilled in the art and suggested by this disclosure. It is further desired that this connection system be capable of carrying high current uninterrupted from contamination.

A connector according to the present invention satisfies the need for a simple to install, hermetically sealed connector system capable of carrying high current which improves on product robustness by reducing wire terminal losses and increases reliability.

SUMMARY OF INVENTION

According to the present invention, an electrical connector system is adapted to be environmentally sealed by mounting a conductor block sealingly engaged with a port extending through an electrical component. A first cover portion is telescopically engaged with the conductor block and has at least one wire channel formed therein.

A second cover portion is applied to a first cover portion, with the second cover having at least one wire channel formed therein such that conductor leads passing through said cover portions will be sealingly engageable with said first and said second cover portions.

A connector according to the present invention is particularly well suited for interconnecting components in an automotive environment; however, it should be appreciated that this electrical connection system will be useful for many non-automotive applications. These and other advantages of the present invention, as well as objects and features of the invention which will be readily apparent from the drawings, discussion and description, which follow.

DETAILED DESCRIPTION

Figure 1:
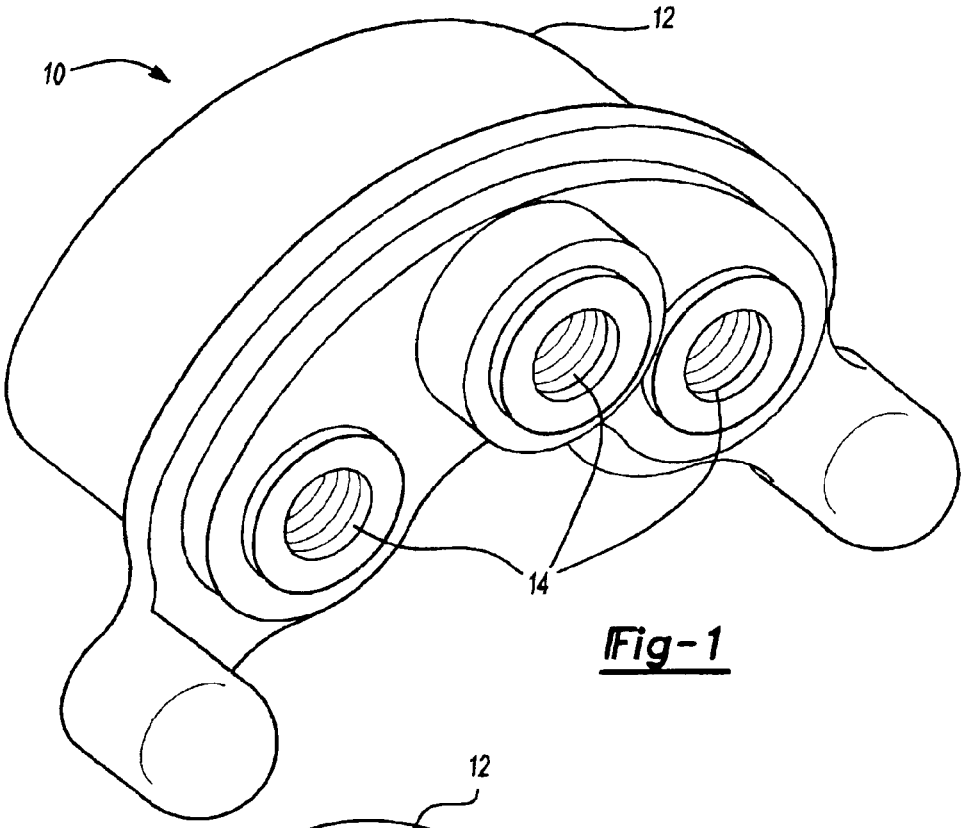
FIG. 1 is a perspective view of a rear portion of a conductor block according to the present invention.

With reference to FIG. 1 of the drawings, electrical connector 10 generally includes conductor block 12 containing a plurality of electrical conductors 14.

Conductor block 12 may be made of thermosetting compound or any other non-conductive material typically used in various types of electrical connectors. Electrical conductors 14, which will be described in greater detail below, are disposed in conductor block 12 by either being molded into place or pressed into conductor block 12. The resulting interference between the electrical conductor 14 and the conductor block 12 provides a sealing feature to prevent both contamination from interfering with the electrical conductors 14, and fluid leakage.

Figure 2:
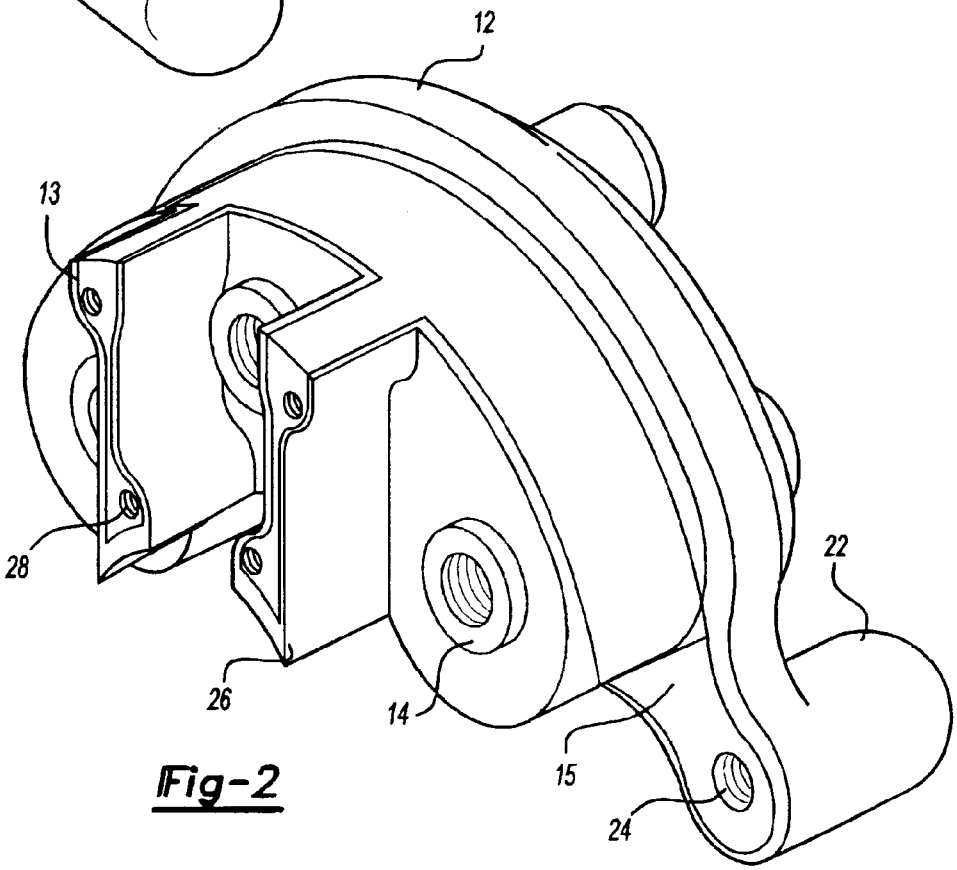
FIG. 2 is a perspective view of a front portion of a conductor block according to the present invention.

With reference to FIG. 2 of the drawings, the front portion of conductor block 12 includes mounting lugs 22, having threaded apertures 24 allowing conductor block 12 to be mounted through a port located in an electrical component (not shown in FIG. 2). As described briefly above, electrical conductors 14 are designed as solid conductors that entirely fill cavities in conductor block 12. This design prevents fluids or other contaminates from passing through the front and rear portions of the conductor block 12.

The front portion 13 of conductor block 12 further includes guide posts 26 that separate electrical conductors 14 and contain holes 28, whereby a cover (40) (not shown in FIG. 2) can be affixed to conductor block 12. Additionally, the front portion of conductor block 12 includes a metallic shield 15, which provides an electrical path for the purpose of controlling electromagnetic interference "EMI", as is more fully explained in connection with FIG. 5.

Figure 3:
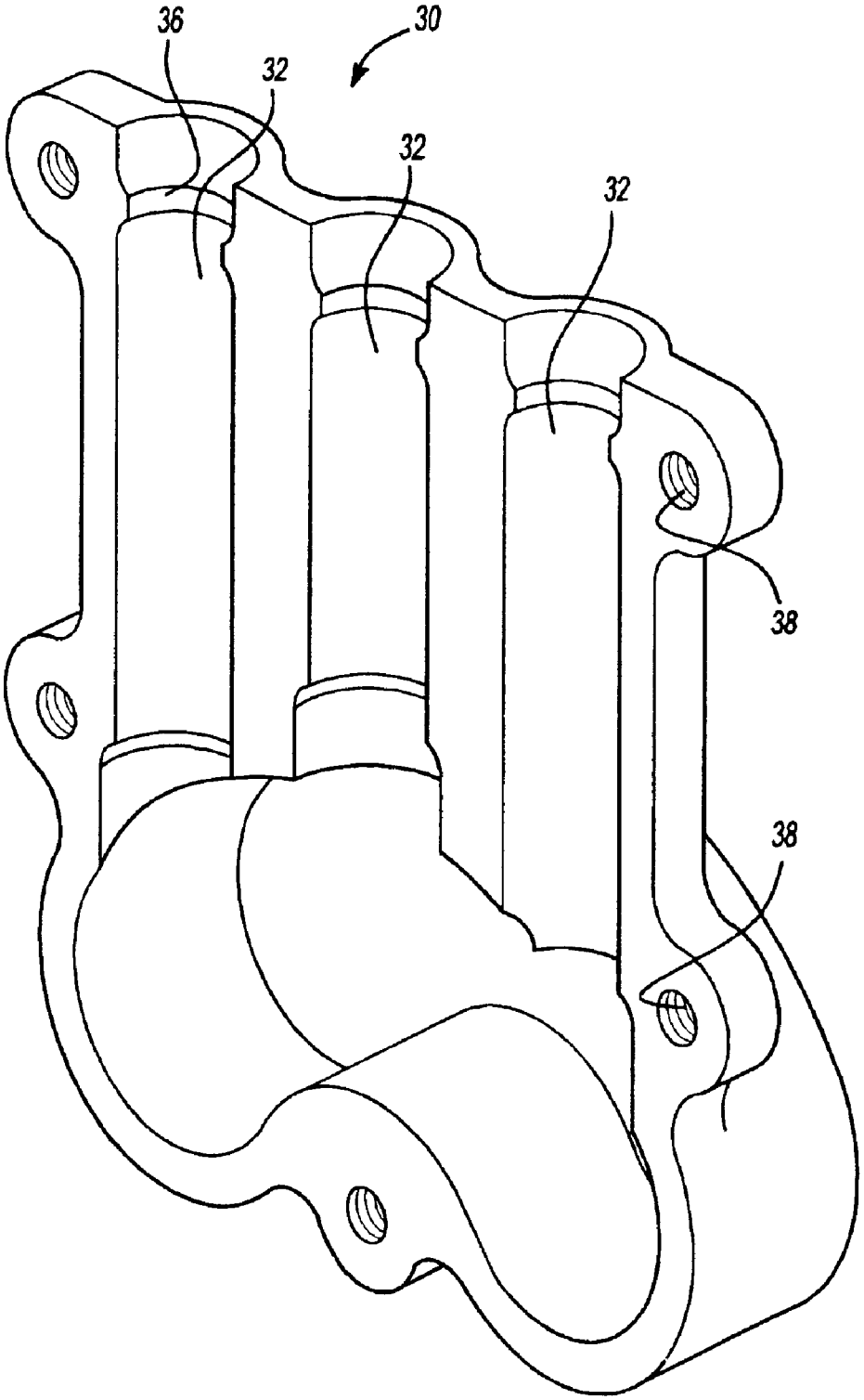
FIG. 3 is a perspective view of a first cover portion according to the present invention.

With reference to FIG. 3 of the drawings, first cover portion 30 is preferably molded in thermosetting material. Each wire channel 32 are formed in cover portion 30 to create a routing path for electrical leads. Wire channels 32 include a dimpled edge 36 which assists in forming a seal around an electrical lead when a second cover portion 40 (not shown in FIG. 3) is connected to first cover portion 30. Additionally, first cover portion 30 includes mounting apertures 38 that are used to mount second cover portion 40 as viewed in FIG. 4.

Figure 4:
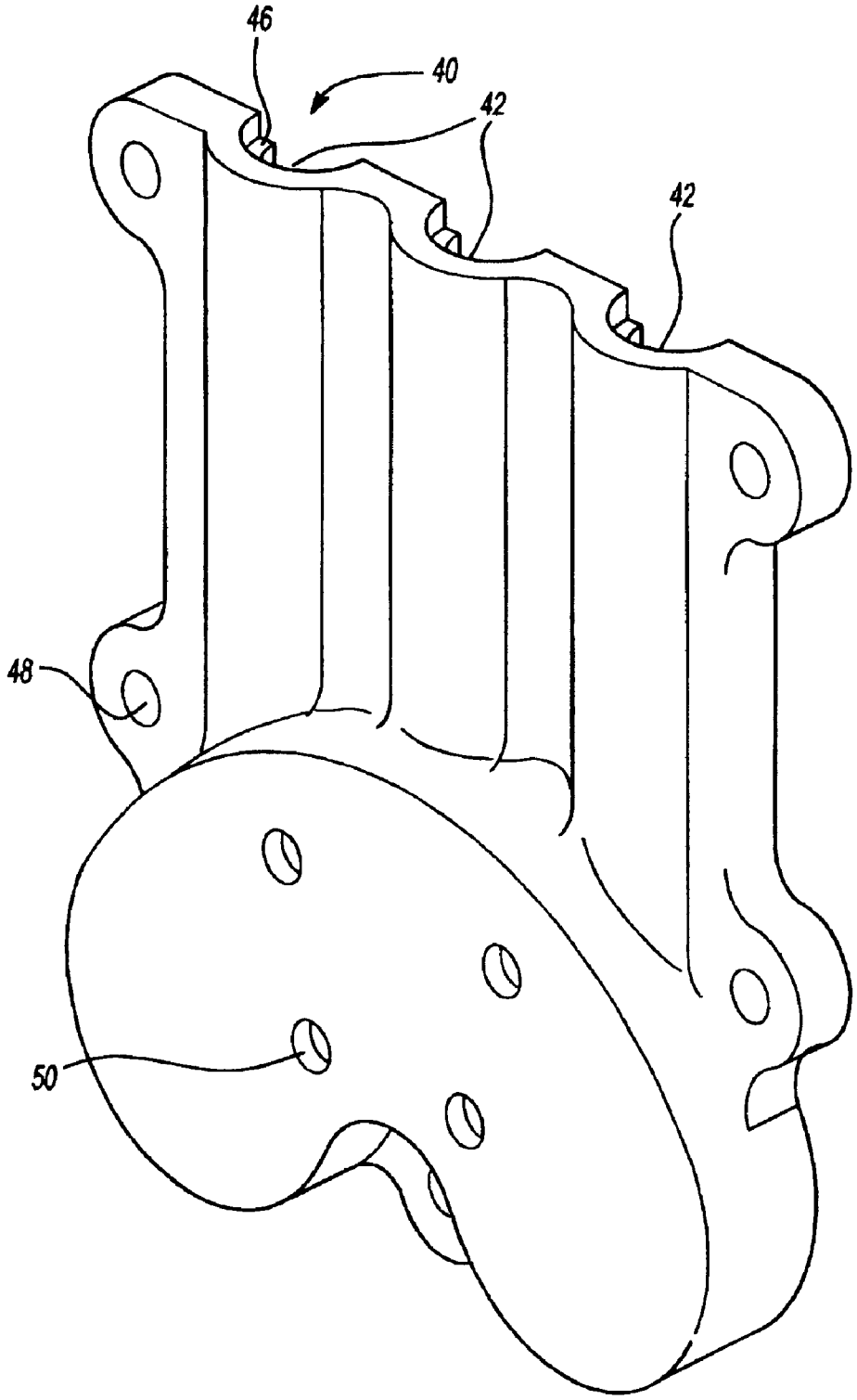
FIG. 4 is a perspective view of a second cover portion according to the present invention.

FIG. 4 illustrates second cover portion 40 according to the present invention. In a preferred embodiment, second cover portion 40 is molded for example, in thermosetting material and designed to sealingly cover first cover portion 30 and conductor block 12. Wire channels 42 are formed in the thermoset of second cover portion 40 to aid with the routing of electrical leads when they are attached to the conductor block 12. Wire channels 42 include a dimpled edge 46 for sealing purposes. Electrical leads (not shown in FIG. 4) are compressed between first cover portion 30 and the second cover portion 40 forming a seal around the insulation of the leads. Mounting holes 48 are included in second cover portion 40 to allow for attachment to first cover portion 30. Additionally, apertures 50 are provided to affix second cover portion 40 to conductor block 12.

Figure 5:
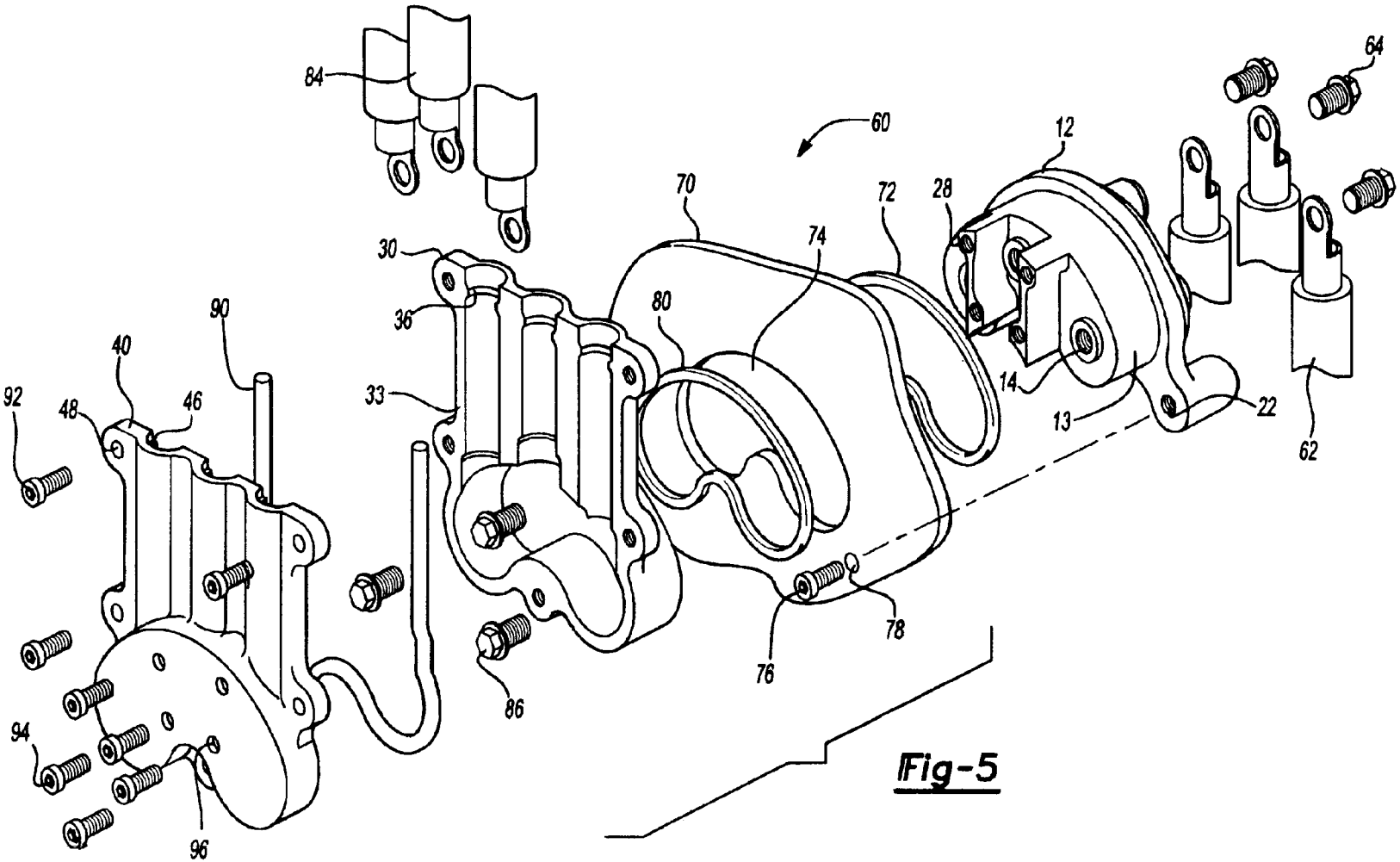
FIG. 5 is an exploded perspective view of a connector assembly according to the present invention.

FIG. 5 illustrates an exploded view of the electrical connector system 60. The elemental parts of an electrical connector system 60 according to the present invention may be combined to form a hermetically sealed system as follows. First, conductor block 12 is positioned such that electrical leads 62 may be attached with bolts 64 to electrical conductors 14 extending from a rear portion of conductor block 12.

Prior to insertion of conductor block 12 into a port 74 extending through component 70, a seal or other sealing mechanism 72 is placed over the front portion of conductor block 12. Seal 72 provides a resilient sealing engagement when the front portion of conductor block 12 is inserted through port 74 of electrical component 70 which may comprise, a dash panel, transmission, switchgear or other electrical device. More particularly, conductor block 12 is placed within port 74 a wall, panel or other surface so that the front portion 13 of conductor block 12 protrudes through port 74. Fasteners, such as screws 76 are used to affix conductor block 12 to electrical component 70 by inserting fastener 76 through component hole 78 and electrical conductor hole 22.

After conductor block 12 is mounted in its permanent position, first cover portion 30 is telescopically placed over the front portion 13 of conductor block 12. Seal 80 is placed between first cover portion 30 and electrical component 70 so as to provide for a resilient sealing engagement, whereby contaminates such as fluids are prevented from escaping between the walls of port 74 and conductor block 12.

Electrical leads 84 are attached with fasteners 86 to front side of electrical conductors 14. The attachment of the electrical leads 84 prevents the first cover portion 30 from becoming dislodged from the front portion of conductor block 12.

Additionally, the attachment of electrical leads 84 achieves the desired electrical contact required between the ends of the electrical conductors 14. It is envisioned that electrical conductors 14 may be female or male type conductors and it will be understood that either may be used to attach electrical leads thereof.

Seal 90 is applied to inner edge 33 of first cover portion 30 and edge of second cover portion 40 thus accomplishing a sealing engagement system upon attachment when fasteners 92 are inserted through holes 48. Additionally, a seal is created around electrical leads 84 due to the compression of the insulation that surrounds each electrical lead by dimpled edges 36 and 46. Furthermore, as an enhancement of electrical connector system 60, it is envisioned that a metallic shield 15 shown in FIG. 2 added to the external surfaces of the cover components 30 and 40, with an electrical (copper) path from the cover mounting screws (92) to the electrical component (70) mounting screw (76) provides an electrical path to the electrical component, such as an aluminum transmission housing, for EMI purposes. Once assembled, the electrical connection system 60 is hermetically sealed and electrically isolated as shown in FIG. 7.

Figure 6:
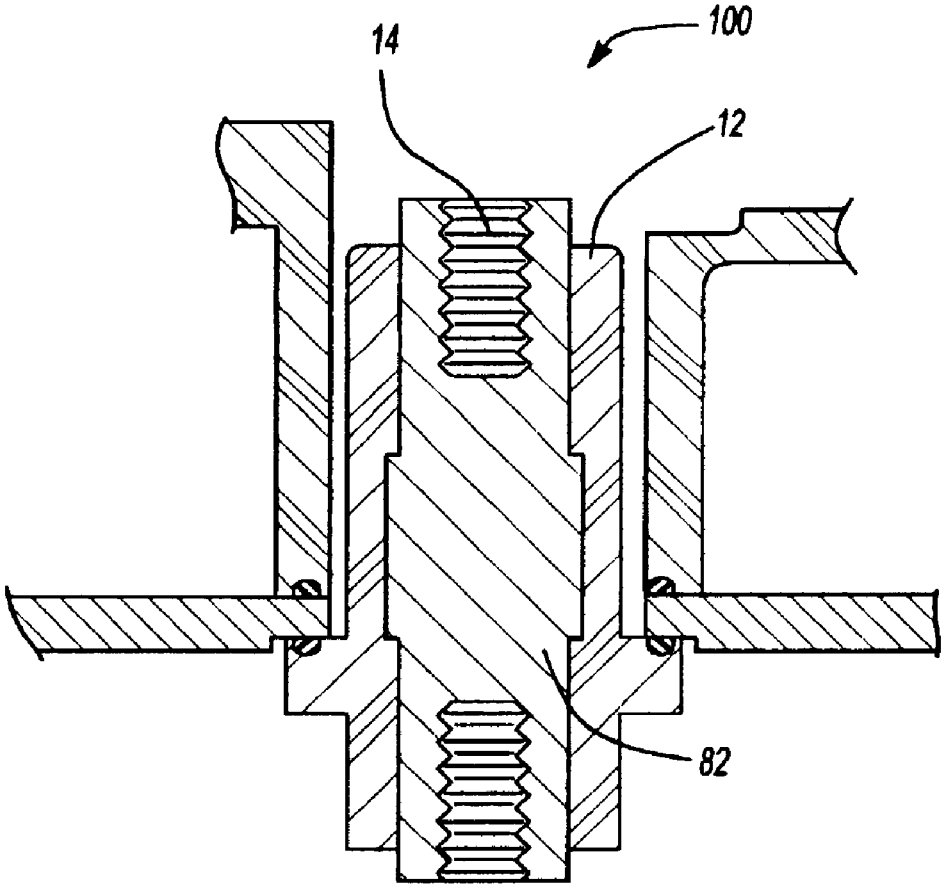
FIG. 6 is a cross-sectional view of an electrical conductor found in a conductor block according to the present invention.

FIG. 6 is a cross-sectional view of electrical conductor 14 as formed in conductor block 12. Electrical conductor 14 can either be molded into conductor block 12 or pressed into the block. The electrical conductor 14 is made of highly conductive material, such as copper, capable of carrying electrical current at high amperages. Electrical current is transferred through the electrical conductor stem 82 when electrical leads (not shown in FIG. 6) are attached to both ends of the conductor 14.

Figure 7:
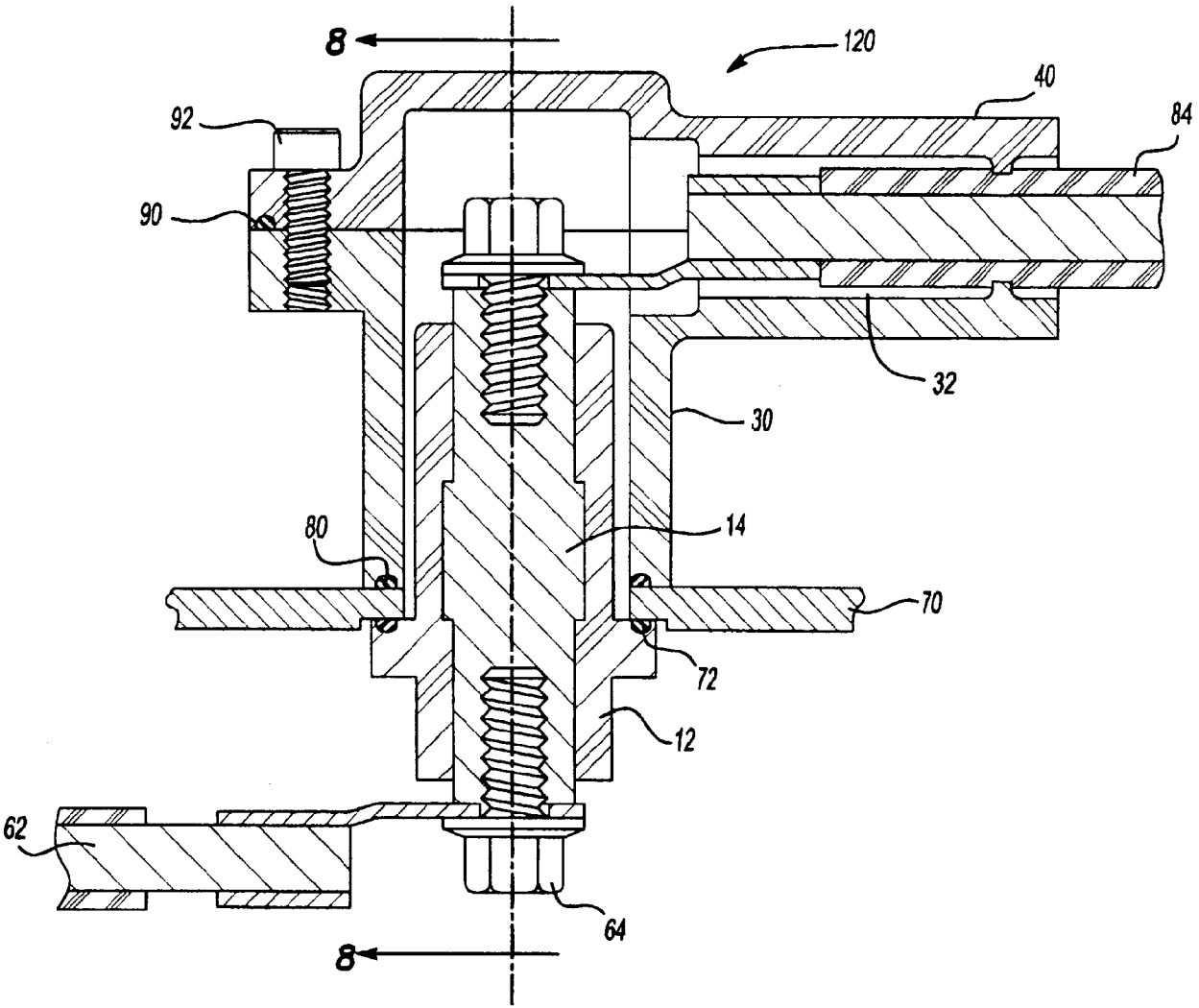
FIG. 7 is a cross-sectional view of an electrical connection assembly according to the present invention.

FIG. 7 illustrates cross-sectional view of electrical connection system 60 as assembled according to FIG. 5.

Figure 8:
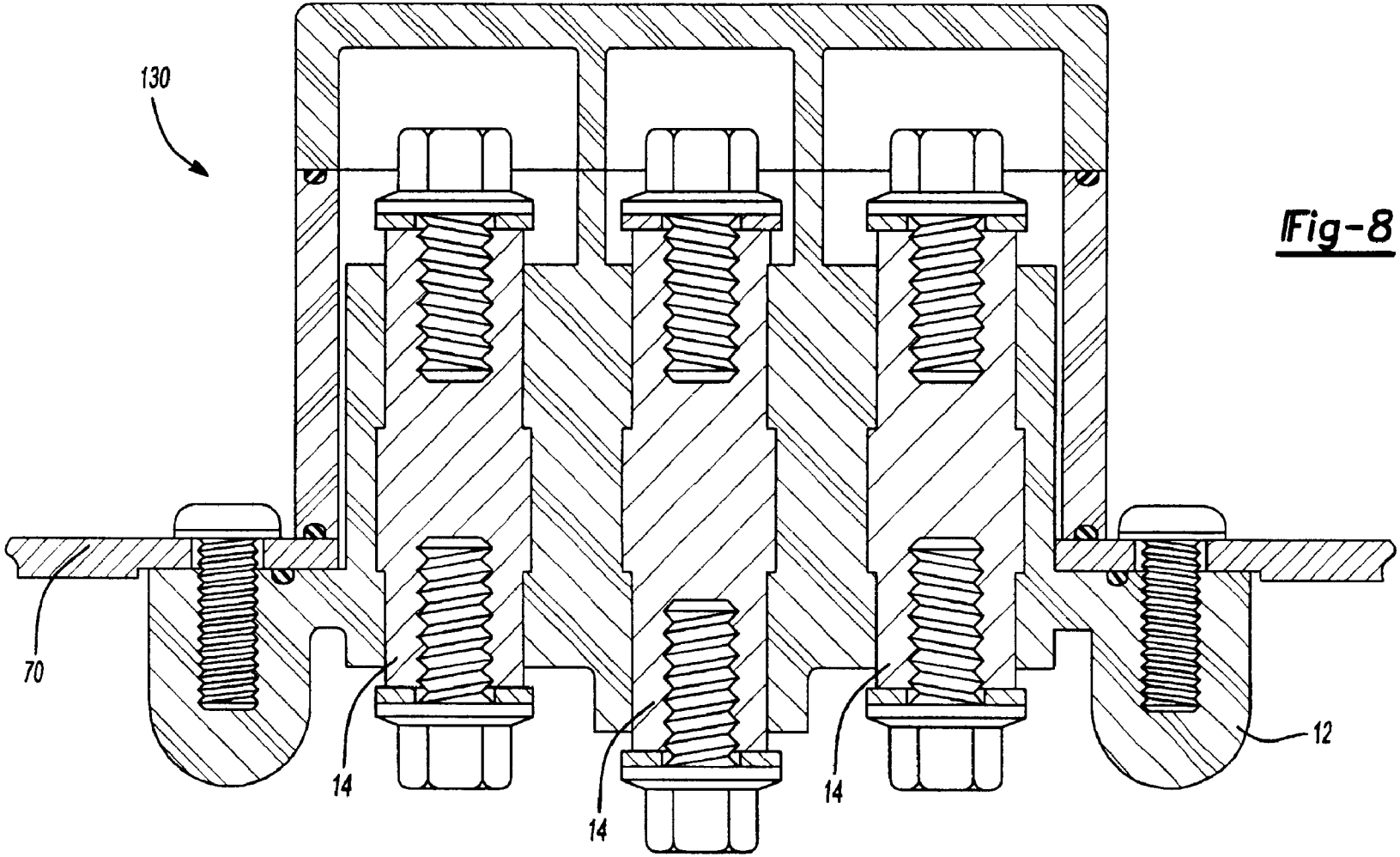
FIG. 8 is a sectional view partially broken away, taken along line 8——8 of FIG. 7.

FIG. 8 a sectional view 130 taken along line 8——8 of FIG. 7 shows a plurality of electrical conductors 14 formed in conductor block 12. Each of the electrical conductors is sealed independently against the conductor block 12 to prevent fluid wicking. At least one of the electrical conductors 14 centered on rear portion of conductor block 12, is set-off in height to provide that attachment of electrical leads 84 thereto is isolated from remainder of electrical conductors or electrical leads 14 thus preventing electrical shorts.

It is understood that the particular configuration of the preferred embodiment of the present invention was designed with specific packaging requirements for a preferred application. However, it is also understood that the present invention is not limited to a particular construction herein described and/or shown in the drawings, but also comprises any modifications or equivalents within the scope of the claims. For example, a wide range of conductors 14 may be furnished within conductor block 12.

What is claimed is:

1. An electrical connection system, comprising:

a conductor block sealingly engaged with a port extending through an electrical component;

a first cover portion telescopically engaged with said conductor block and having at least one wire channel formed therein; and a second cover portion applied to said first cover portion with said second cover having at least one wire channel formed therein such that conductor leads passing through said cover will be sealingly engaged with said first and said second cover portions.

2. An electrical connection system according to claim 1, further comprising a retention mechanism for mounting said conductor block to said electrical component.

3. An electrical connection system according to claim 1, further comprising a seal formed between said conductor block and said electrical component.

4. An electrical connection system according to claim 1, wherein at least one electrical conductor is constructed from highly conductive material.

5. An electrical connection system according to claim 4, wherein said electrical conductor includes a solid stem portion sealed within said conductor block so as to prevent fluid leakage from a front portion of said conductor block to a rear portion of said conductor block.

6. A method of producing a hermetically sealed electrical connection to a component comprising the steps of:

sealingly mounting a conductor block within a port extending through an opening of an electrical component;

telescopically and sealingly engaging a first cover portion to an outer portion of said conductor block so as to provide a wire guide for electrical leads to be attached to said conductor block;

attaching electrical leads to said conductor block utilizing said wire guide to prevent dislodgment of said first cover from said conductor block; and attaching a second cover portion to said first cover portion and to said conductor block, thereby sealing said electrical conductors within said wire guide, and sealing said first cover portion and said second cover portion.

7. An electrical connector system for use under environmentally adverse conditions, comprising:

a non-conductive block having a front portion adapted to be disposed from the exterior of an electrical component and a rear portion adapted to be disposed within the interior of an electrical component and at least one electrical conductor spatially separated from another conductor therein;

a seal disposed against and extending about the periphery of said front portion of said non-conductive block and adapted to engaged with an outer wall of an electrical component;

a first cover portion telescopically engaged with said non-conductive block, with said first cover portion being capable of housing electrical leads and having a seal adapted to be disposed against and extend between said first cover portion and an electrical component; and a second cover portion configured to engage with said first cover portion with a seal being disposed between said first cover portion and said second cover portion and wherein said second cover portion configured to engage said non-conductive block whereby electrical leads are retained therein.

8. An electrical connector system according to claim 7, wherein said non-conductive block having a front portion comprising a metallic shield engageable with said second cover to provide an electrical path for EMI shielding.

* * * * *